US007516846B2

(12) United States Patent
Hansen

(10) Patent No.: US 7,516,846 B2
(45) Date of Patent: Apr. 14, 2009

(54) AMPOULE

(76) Inventor: Bernd Hansen, Talstr. 22-30, 74429 Sulzbach-Laufen (DE)

( * ) Notice: Subject to any disclaimer, the term of this patent is extended or adjusted under 35 U.S.C. 154(b) by 567 days.

(21) Appl. No.: 10/546,925

(22) PCT Filed: Jan. 22, 2004

(86) PCT No.: PCT/EP2004/000473

§ 371 (c)(1),
(2), (4) Date: Aug. 25, 2005

(87) PCT Pub. No.: WO2004/091472

PCT Pub. Date: Oct. 28, 2004

(65) Prior Publication Data

US 2006/0163109 A1 Jul. 27, 2006

(30) Foreign Application Priority Data

Apr. 17, 2003 (DE) ..... 103 17 665

(51) Int. Cl.
*A61J 1/06* (2006.01)
*A61J 1/00* (2006.01)

(52) U.S. Cl. ..... 206/528; 206/571; 215/48; 215/902

(58) Field of Classification Search ..... 215/48, 215/902, 262, 307; 106/528, 530; 206/528, 206/530, 571

See application file for complete search history.

(56) References Cited

U.S. PATENT DOCUMENTS

| | | | | |
|---|---|---|---|---|
| 3,630,199 | A | | 12/1971 | Gangarosa et al. |
| 4,055,282 | A | * | 10/1977 | Komendowski ..... 222/421 |
| 4,176,755 | A | * | 12/1979 | Winchell ..... 215/48 |
| 4,405,053 | A | * | 9/1983 | Cherot ..... 215/48 |
| 5,533,633 | A | * | 7/1996 | King ..... 215/252 |
| 5,716,346 | A | | 2/1998 | Farris |
| 6,105,831 | A | | 8/2000 | Finezilber |

FOREIGN PATENT DOCUMENTS

| | | |
|---|---|---|
| DE | 39 16 840 C2 | 3/1990 |
| EP | 0 326 391 B1 | 8/1989 |
| FR | 2 288 445 | 5/1976 |

* cited by examiner

*Primary Examiner*—Sue A Weaver
(74) *Attorney, Agent, or Firm*—Roylance, Abrams, Berdo & Goodman, L.L.P.

(57) ABSTRACT

A plastic ampoule includes a container (12) for receiving a defined fluid, with a neck (14) that can be closed by a head (16). The neck has a channel-type entrance port (24) for air to the interior (26) of the container (12). The fluid can be safely stored and a syringe or needle base is reliably filled at any speed of withdrawal by the syringe or needle base. For this purpose, the entrance port (24) for air includes at least one ring channel (28, 30) that is at least partially disposed on the outer and/or inner periphery of the neck (14).

18 Claims, 4 Drawing Sheets

AMPOULE

FIELD OF THE INVENTION

The present invention relates to a plastic ampoule with a container part for holding a definable fluid. The container is provided with a neck part which can be closed by a head part and which has a channel-like entry point for air into the interior of the container part.

BACKGROUND OF THE INVENTION

DE 39 16 840 C2 discloses a dimensionally stable plastic ampoule for a liquid (fluid) which can be withdrawn from the ampoule by a syringe body. The syringe body, on its end to be inserted into the ampoule neck, has a withdrawal nozzle in the form of a cone. The inside wall of the ampoule neck in the area intended for contact with the cone is provided with a sealing zone preventing passage of liquid between the cone wall and the inside wall of the ampoule neck and yielding contact along a circular line. In that in the known solution, the free end of the neck of the ampoule is configured as a contact surface for the face of the syringe body bearing the cone. In the longitudinal direction of the neck, the free end has a distance from the sealing zone. When the face of the syringe body abuts the contact surface of the neck, the contact pressure of the cone against the inside wall of the neck is limited to a value which ensures entry of air between the wall of the cone and the inside wall of the neck while maintaining an obstruction for passage of liquid. When the syringe is drawn up normally by the syringe plunger, liquid can be easily withdrawn manually, even if the ampoule, as is customary, is standing on its head for the withdrawal process, that is, with its neck part is pointing down.

In practical applications, a very rapid drawing-up process by the syringe can cause a type of short. The liquid remains in the container part of the ampoule. Essentially, only air is subsequently suctioned into the syringe body in the withdrawal process. That air is stored at least also in part in the container part of the ampoule if the ampoule is not completely filled with the pharmaceutical liquid.

Attempts have been made to achieve increased air entry from the outside to the inside by the inside wall of the ampoule neck in the area intended for contact of the cone of the syringe body forming an annular bead. The annular bead projects radially to the inside from the adjacent inside wall areas. A section of the neck part intended for contact with the cone on its inside is provided with at least one longitudinal or axial groove. The groove is open to the inside and extends parallel to the longitudinal axis of the ampoule to raise the entry point for ambient air in this way. Such attempts are not proven sufficient to effectively solve the problem of a ventilation short in rapid withdrawal processes.

U.S. Pat. No. 5,716,346 discloses a process for filling a syringe or cannula with injectable fluids from a storage ampoule. The syringe is equipped with a first coupling element and an opening connected to the inner cylindrical cavity of the syringe (Luer lock system). The liquid flows past the first coupling element and through the opening into the cylindrical cavity and fills the syringe or cannula. In this way, a connection is established which is sealed liquid-tight. Accordingly, the ampoule can be provided with elastic walls which collapse under the negative pressure in the withdrawal process by the syringe or cannula body, and thus, ensure the withdrawal process. The pertinent withdrawal process which is to take place airtight with the known device consequently cannot be applied to dimensionally stable ampoules in this way. As a result of the "collapsible ampoule walls", a negative pressure forms within the ampoule with the result that in the withdrawal process by the syringe the contents are necessarily suctioned back again into the ampoule.

SUMMARY OF THE INVENTION

An object of the present invention is to provide an improved ampoule design such that a reliable storage possibility of fluid in ampoule bodies is created and, at any rate of withdrawal by the syringe or cannula body, reliable filling of the latter is achieved.

This object is basically achieved by an ampoule with an entry point for air having at least one annular channel configured at least partially on the outer and/or inner circumferential side on the neck part of the ampoule. It then becomes possible to a high degree for the ambient air to be able to penetrate into the interior of the container part. In this way, regardless of the withdrawal rate on the actuating plunger of the syringe or cannula body, reliable, complete withdrawal of the contents of the ampoule in the form of a pharmaceutical liquid is effected. The described shorts in the withdrawal process are reliably precluded with the solution of the present invention.

Due to the annular channel made in the neck part for the air to flow, a swirl guide forms around which the withdrawn liquid flows on the outer circumferential side in the withdrawal process in the neck part. In terms of flow engineering, this flow is favorable for the withdrawal process. Preferably, the respective annular channel is configured helically on the neck part over a definable thread distance. The helical annular channel preferably has an inlet and outlet point so that in this way only conical withdrawal nozzles can be fixed on the ampoule according to the contents of DE 39 16 840 C2 which relate to a Luer lock connection as is established in ISO Standard 594/1, first edition, dated Jun. 15, 1986. With this ampoule according to the present invention, connections of the syringe bodies and cannulas can be established, as are described in ISO Standard 594/2, first edition, dated May 1, 1991, under part 2, Lock fittings.

In another preferred embodiment of the ampoule of the present invention, the annular channel with its groove-shaped recess is interrupted at least partially by longitudinal bridges positioned in the mold plane of the container part. In this way, the ampoule with the contents can be formed especially efficiently and economically by a blow molding and filling process. Moreover, the threads of the annular channel are stiffened accordingly.

In another preferred embodiment of the ampoule of the present invention, on the outer circumferential side on the neck part and outside of the respective annular channel, a stop part acts as protection against stripping. In particular, connection pieces as per part 2 of the indicated ISO standard can be fixed reliably on the ampoule with its neck part and removed after the withdrawal process by twisting off of the neck part without hindrance.

Other objects, advantages and salient features of the present invention will become apparent from the following detailed description, which, taken in conjunction with the annexed drawings, discloses preferred embodiments of the present invention.

BRIEF DESCRIPTION OF THE DRAWINGS

Referring to the drawings which form a part of this disclosure.

DETAILED DESCRIPTION OF THE INVENTION

Figure 1:
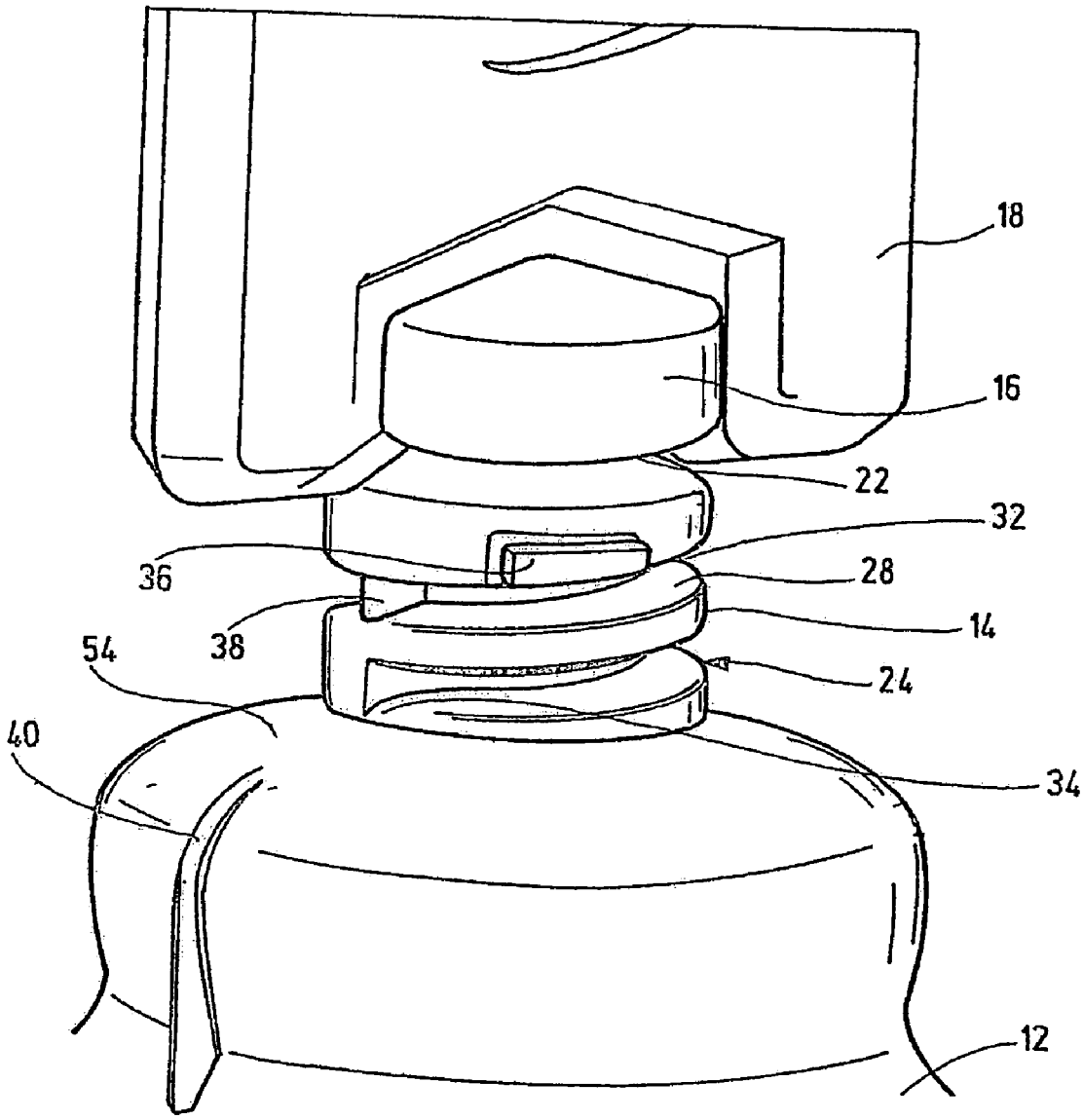
FIG. 1 is a diagrammatic perspective view, not to scale, of the upper container part of an ampoule with the neck part and toggle closure according to a first embodiment of the present invention.

FIG. 1 shows the top part of a dimensionally stable plastic ampoule produced in a blow molding process and containing a pharmaceutical liquid which can be withdrawn by a syringe or a cannula. The container part 12 of the pertinent ampoule is shown for example in its entirety in FIGS. 1 and 2 of DE 39 16 840 C2. The top of the container part 12 is adjoined by an essentially cylindrically configured neck part 14. The neck part can also be provided toward its free side conically with a slight incline (not shown). The neck part 14 of the ampoule adjoins a head part 16 which is made integrally with it and which for its part is made integrally with a molded-on toggle part 18. The neck part 14, the head part 16 and the toggle part 18 are conventionally molded following the filling of the container part 12, at the same time with molding. The container part 12 with its container contents in the form of a fluid is sealed under sterile conditions. To clear the neck opening 20 (cf. FIG. 2), a separating point 22 is formed between the neck part 14 and the head part 16. To form the separating point 22, the neck part 14 and the head part 16 are tapered conically on their sides facing one another. If the toggle part 18 is turned by hand relative to the container part 12, the head part 16 shears off the neck part 14 at the separating point. In this way, the neck part opening 20 is then cleared for a fluid withdrawal process.

Figure 2:
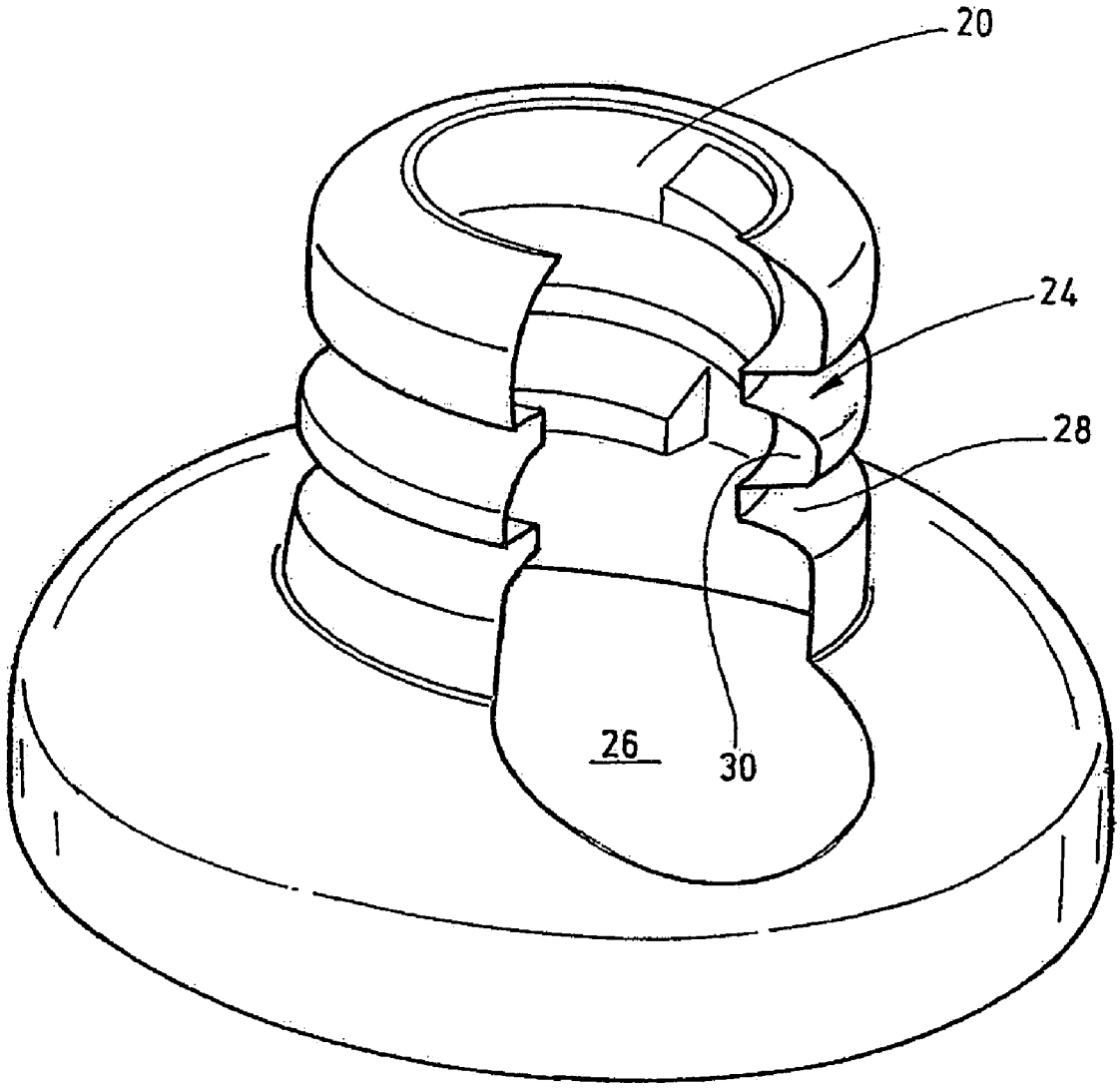
FIG. 2 is a perspective, cutaway view of the neck part with the top part of the container of FIG. 1.
Figure 3:
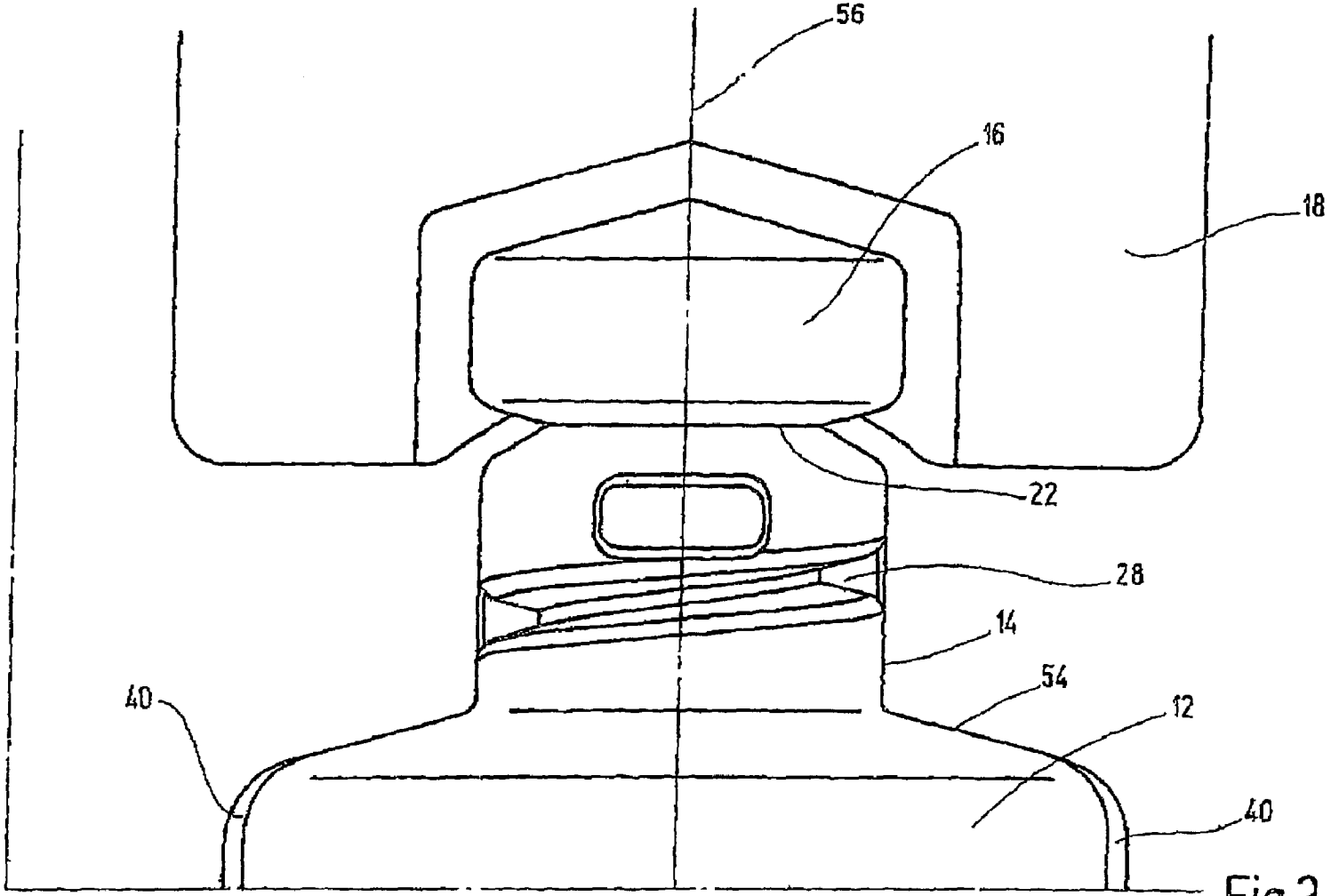
FIG. 3 is a side elevational view of the upper container part with the neck part and toggle closure according to a second embodiment of the present invention.

As FIGS. 1 to 3 show, the neck part 14 is provided with a channel-like entry point 24 for the supply of air to the interior 26 of the container part 12. The entry point 24 for air comprises two annular channels 28, 30. The first or outer annular channel 28 is located on the outer circumferential side of the neck part 14. The second or inner annular channel 30 is located on its inside circumference of the neck part (cf. FIG. 2). As can furthermore be seen from FIGS. 1 and 2, each annular channel 28, 30 is configured helically in the form of a screw thread over a definable thread distance on the neck part 14. The respective helical annular channel 28, 30 has an inlet point 32 and an outlet point 34. This arrangement facilitates screwing or threading the connecting part of a syringe or cannula body on and off, as will be detailed below. The profile shape of the respective annular channel 28, 30 is that of a trapezoid. The single-turn thread allows one full turn by approximately 360°.

The ampoule on the outer circumferential side on the neck part 14, and, preferably positioned outside the respective annular channel 28, has as stop part 36 protecting against stripping for the syringe or cannula body which is to be screwed on. In this way, damage to the thread parts and to the neck part 14 of the container 12 of the ampoule is reliably avoided. The corresponding stop parts (not shown) can also be provided with respect to the inner annular channel 30 on the inside of the neck part 14 to form protection against stripping on the inner circumferential side. The outer annular channel 28 with its groove-shaped recess is interrupted by two longitudinal bridges 38 on the neck part 14, diametrically opposite one another. Bridge 38 forms an extension of the mold bridges 40 located in the same plane on the container part 12, and form a separating plane on which the mold halves of the mold of the blow molding machine (not shown) used to produce the ampoule abut one another. The annular channel 28 and consequently also the neck part 14 can be stiffened by the longitudinal bridges 38 so that the thread is preserved even at a high screwing-on moment.

The thread formed by the respective annular channel 28, 30 can be dictated by its screw-in distance. In the embodiment shown in FIG. 3, more or less in the middle of the neck part 14, a thread turn shortened in the circumferential direction is provided with a stop part 36 as protection against stripping. This stop part lies over the thread turn when viewed in the direction of FIG. 3.

Figure 4:
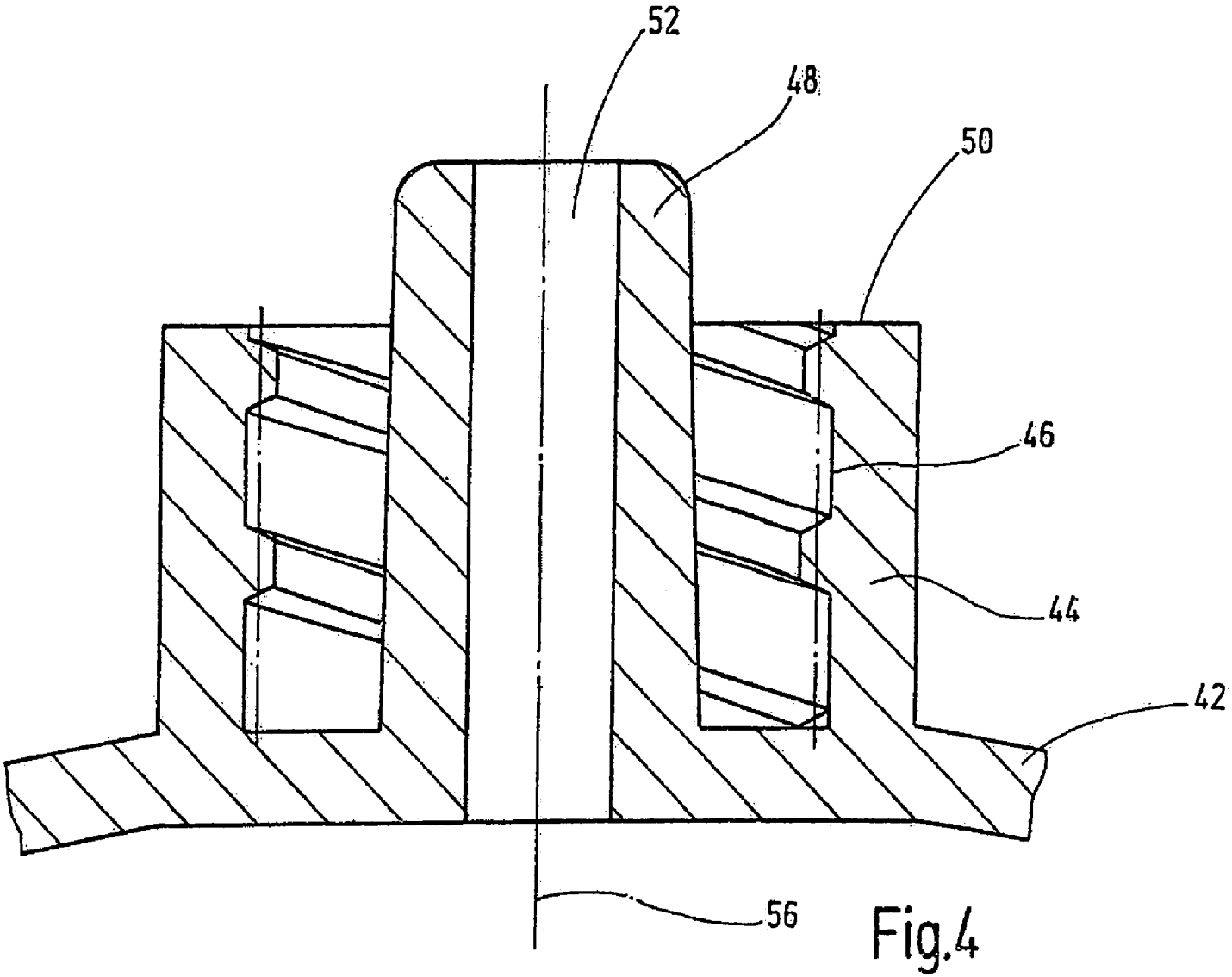
FIG. 4 is a side elevational view in section of the front part of the cannula body or syringe body according to ISO 594-2, first edition, dated May 1, 1991.

FIG. 4 now shows the face end of the cannula body 42 according to ISO Standard 594-2, first edition, dated May 1, 1991, part 2. This cannula body 42 on its free end has a fixing part 44 with an inside thread 46. In its middle, the fixing part 44 is penetrated by a withdrawal opening 48 on the fixing part face and having a definable projection overlapping the free stop end 50 of the fixing part 44. The withdrawal opening 48 is provided with a center channel 52 which enables liquid withdrawal from the ampoule 10 via the neck part opening 20 if the plunger part of the cannula body 42 (not shown) is pulled out of its front position into its back position.

When the head part 16 is removed by the toggle part 18, the neck part 14 with its neck part opening 20 is cleared. The inside thread 46 of the fixing part 44 of the cannula body 42 can be then screwed clockwise onto the helical annular channel 28 on the outside circumference of the neck part 14 of the ampoule for a withdrawal process. The screwing-on process takes place until either the free stop end 50 comes into contact with the top 54 of the container part 12 which tapers slightly conically for this purpose, and/or until part of the inside thread 46 abuts the stop part 36 of the neck part 14, delimiting it, and in this way stops the screwing-on motion.

Since the top 54 of the container part 12 tapers slightly conically and the stop end 50 is configured as a stop ring which extends flat and transversely to the longitudinal axis 56 of the cannula body 52 and the ampoule, a gap is formed through which air flows into the annular channel 28 of the neck part 14. As a result of the generously dimensioned cross sectional shape in the form of a trapezoidal thread profile, a relatively large amount of air travels via the inlet point 32 of the annular channel 28 into the edge-side area of the neck part opening 20 and from there into the opening 20 and into the interior 26 of the container part 12. Even for very rapid withdrawal processes in which the plunger of the cannula is moved instantaneously to the rear out of the cannula body 42, in the process so much air continues to flow in subsequently via the annular channel 28 that a negative pressure adversely affecting the withdrawal process cannot occur in the ampoule. The fluid can be removed directly from the ampoule. The shorting processes which are experienced in the prior art and in which only air is then subsequently suctioned in, are reliably prevented by the present invention.

The withdrawal process is further promoted for the purpose of swirl guidance. The amount of air supplied by the annular channel 28 is conveyed by the neck part opening 20 along the inner annular channel 30 into the interior 26 of the container part 12. Depending on the withdrawal situation, it can also be sufficient according to FIG. 3 to provide only one segment of an inner annular channel 30 or an outer annular channel 28. Preferably, as shown in FIG. 2, the groove-shaped thread depressions extend from the outer annular channel 28 and the inner annular channel 30 in an alternating sequence along the neck part 14. When the withdrawal process has ended, the cannula body 42 can be removed from the ampoule 10 in the direction opposite direction of rotation, as described, and the ampoule can be disposed of in the conventional manner.

Although the outer annular channel 28 is used as a counterpart for the inside thread 46 of the cannula body 42, the free annular channel cross sections are dimensioned such that air can subsequently flow more or less unobstructed from the outside into the interior of the container part 12 for a withdrawal process, preferably as a kind of swirl guide. The configuration of the present invention is also suited for those cannula bodies which do not have an inside thread 46 on the fixing part 44, but have a smoothly running stop surface (not shown) there. The ampoule can also be used for Luer connections as per ISO 594/1, first edition, dated Jun. 15, 1986, in which only a conical withdrawal cone is present, comparable to the withdrawal opening 48 as shown in FIG. 4. The corresponding air guidance is then managed by the internally running annular channel 30 of the neck part 14. In spite of the complex annular channel geometry in the form of a screw helix, this withdrawal device for the ampoule is cost-effective to manufacture so that compared to the other known solutions no additional costs arise. Compared to known solutions, the ampoule of the present invention achieves a reliable and quick fluid withdrawal process by a cannula or syringe body.

While various embodiments have been chosen to illustrate the invention, it will be understood by those skilled in the art that various changes and modifications can be made therein without departing from the scope of the invention as defined in the appended claims.

What is claimed is:

1. A plastic ampoule, comprising:

a container part for holding a liquid in an interior thereof;

a neck part extending from said container part having inner and outer circumferential sides;

a removable head part releasably sealing a neck opening of said neck part; and at least one outer annular channel at least partially on said outer circumferential side forming a counterpart for an inside surface of a cannula body, said outer annular channel forming free annular cross-sectional areas between said neck part and a mating cannula body allowing substantially unobstructed air flow from outside said container through said neck opening to said interior during removal of the liquid from said container part.

2. A plastic ampoule according to claim 1 wherein said outer annular channel extends helically on said neck part over a definable thread distance.

3. A plastic ampoule according to claim 2 wherein said outer annular channel comprises an outlet point.

4. A plastic ampoule according to claim 2 wherein said annular channel has a profile shape configured as one of a metrical thread, a trapezoidal thread and a Whitworth thread.

5. A plastic ampoule according to claim 1 wherein said outer annular channel comprises a groove-shaped recess interrupted at least partially by longitudinal bridges in a mold plane of said container part.

6. A plastic ampoule according to claim 1 wherein a stop part is on said outer circumferential side of said neck part and is outside of said outer annular channel, protecting against stripping.

7. A plastic ampoule according to claim 1 wherein an inner annular channel extends on said inner circumferential surface.

8. A plastic ampoule according to claim 7 wherein said inner annular channel is helical.

9. A plastic ampoule kit, comprising:

a cannula body having a generally cylindrical fixing part with an inside surface about a withdrawal opening;

a container part for holding a liquid in an interior thereof;

a neck part extending from said container part having inner and outer circumferential sides;

a removable head part releasably sealing a neck opening of said neck part; and at least one outer annular channel at least partially on said outer circumferential side forming a counterpart for said inside surface of said cannula body, said outer annular channel forming free annular cross-sectional areas between said neck part and said inside surface of said cannula body allowing substantially unobstructed air flow from outside said container through said neck opening to said interior during removal of the liquid from said container part and into said cannula body.

10. A plastic ampoule kit according to claim 9 wherein said outer annular channel extends helically on said neck part over a definable thread distance.

11. A plastic ampoule kit according to claim 10 wherein said outer annular channel comprises an outlet point.

12. A plastic ampoule kit according to claim 11 wherein said annular channel has a profile shape configured as one of a metrical thread, a trapezoidal thread and a Whitworth thread.

13. A plastic ampoule kit according to claim 9 wherein said outer annular channel comprises a groove-shaped recess interrupted at least partially by longitudinal bridges in a mold plane of said container part.

14. A plastic ampoule kit according to claim 9 wherein a stop part is on said outer circumferential side of said neck part and is outside of said outer annular channel, protecting against stripping.

15. A plastic ampoule kit according to claim 9 wherein an inner annular channel extends on said inner circumferential surface.

16. A plastic ampoule kit according to claim 15 wherein said inner annular channel is helical.

17. A plastic ampoule kit according to claim 9 wherein said inside surface is threaded.

18. A plastic ampoule kit according to claim 9 wherein said withdrawal opening comprises a projection extending coaxially with said cylindrical fixing part.

* * * * *